US008052461B2

(12) United States Patent
Wang

(10) Patent No.: US 8,052,461 B2
(45) Date of Patent: Nov. 8, 2011

(54) BAYONET TYPE ELECTRONIC CONNECTOR

(75) Inventor: Fengliang Wang, Guangdong (CN)

(73) Assignee: Fengliang Wang, Guangdong (CN)

( * ) Notice: Subject to any disclaimer, the term of this patent is extended or adjusted under 35 U.S.C. 154(b) by 0 days.

(21) Appl. No.: 12/935,914

(22) PCT Filed: Mar. 27, 2009

(86) PCT No.: PCT/CN2009/000330

§ 371 (c)(1),
(2), (4) Date: Oct. 1, 2010

(87) PCT Pub. No.: WO2009/121239

PCT Pub. Date: Oct. 8, 2009

(65) Prior Publication Data

US 2011/0028047 A1 Feb. 3, 2011

(30) Foreign Application Priority Data

Apr. 1, 2008 (CN) ..... 2008 2 0079700 U

(51) Int. Cl.
*H01R 4/24* (2006.01)

(52) U.S. Cl. ..... 439/405; 439/449; 439/607.49; 439/607.58

(58) Field of Classification Search ..... 439/405, 439/422, 444, 449, 607.58, 607.49, 904
See application file for complete search history.

(56) References Cited

U.S. PATENT DOCUMENTS

| | | | | | |
|---|---|---|---|---|---|
| 4,721,483 | A * | 1/1988 | Dickie | 439/607.49 |
| 5,118,310 | A * | 6/1992 | Stroede et al. | 439/676 |
| 5,343,547 | A * | 8/1994 | Palecek et al. | 385/76 |
| 5,376,018 | A * | 12/1994 | Davis et al. | 439/405 |
| 5,421,741 | A * | 6/1995 | David et al. | 439/405 |
| 5,833,486 | A | 11/1998 | Shinozaki | |
| 6,062,907 | A * | 5/2000 | Tan et al. | 439/607.41 |
| 6,932,640 | B1 * | 8/2005 | Sung | 439/405 |
| 7,252,548 | B2 * | 8/2007 | Huang | 439/607.01 |
| 2006/0148319 | A1 * | 7/2006 | Huang | 439/607 |
| 2009/0017684 | A1 * | 1/2009 | Lin | 439/610 |
| 2011/0021059 | A1 * | 1/2011 | Lu et al. | 439/345 |
| 2011/0028047 | A1 * | 2/2011 | Wang | 439/673 |
| 2011/0065308 | A1 * | 3/2011 | Lu et al. | 439/449 |

FOREIGN PATENT DOCUMENTS

| | | | |
|---|---|---|---|
| CN | 1154581 | A | 7/1997 |
| CN | 2393227 | Y | 8/2000 |
| CN | 1057642 | C | 10/2000 |
| CN | 201204261 | Y | 3/2009 |
| DE | 69611595 | T2 | 7/1995 |
| EP | 0773599 | A3 | 3/1997 |
| EP | 0773599 | A2 | 5/1997 |
| EP | 0773599 | B1 | 1/2001 |
| JP | 9134745 | A | 5/1997 |

* cited by examiner

*Primary Examiner* — James Harvey
(74) *Attorney, Agent, or Firm* — CKC & Partners Co., Ltd.

(57) ABSTRACT

A bayonet type electronic connector (1) comprises metal contacts arranged on the upper and lower surfaces of the connector (1). Metal contacts all are U-shaped bayonets (2). The U-shaped bayonet's terminal forms a right angle. The adjacent U-shaped bayonets (2) on each surface are staggered fore and aft in two rows. Enough functional space is arranged between the two rows.

19 Claims, 10 Drawing Sheets

BAYONET TYPE ELECTRONIC CONNECTOR

RELATED APPLICATIONS

This application is a co-pending application, which claims priority to PCT Application No. PCT/CN2009/000330 filed Mar. 27, 2009, which are herein incorporated by reference.

BACKGROUND

1. Field of Invention

The present invention relates to fields of household audio-visual appliance and industrial electrical equipment. More particularly, the present invention relates to a bayonet type electronic connector.

2. Description of Related Art

In the fields of household audio-visual appliance, computer, industrial electrical equipment etc., along with the explosive increase of transinformation amount, a multi-contact connector has been more and more widely used, and accordingly the demands for connecting cables among equipments are daily increasing. However, with the miniaturization and micromation of connector contacts as well as the increase in the number of the contacts, a conventional solder-type method faces more and more difficulties in processing cables. The connecting wires fabricated by soldering have the disadvantages of low fabrication efficiency and unstable electrical performance.

There is a row of parallel soldering points (or solder pads) 7 arranged on the tail end of a solder-type multi-contact connector to make a solder connection with the cable conductor, as shown in FIG. 1. The conventional soldering method needs a lot of complicated manual operations such as cutting, stripping, positioning, soldering and trimming, and thus has the disadvantages of low efficiency and unstable performance and also becomes a bottleneck that troubles the connector, cable and electronic equipment manufacturers.

Although there a U-shaped bayonet type multi-contact connector disclosed in the prior art, such as China Patent No. 1249855A, yet the following defects still exist:

1. The U-shaped bayonets and the metal contact plates are arranged at 180°, i.e. in a line shape, wherein the adjacent contact plates have to be turned away, this losing the current balance, causing a sharp increase of the characteristic impedance and producing higher high-frequency attenuation. Therefore, the U-shaped bayonets can only be used in the situation of low frequency:

2. The U-shaped bayonets are only suitable for clamping ribbon cables; and

3. The bayonets are distributed on a single side, thus resulting in narrow space.

SUMMARY

In order to solve the aforementioned problems, the present invention discloses a connector for connecting electrical appliances, wherein the soldering points of a conventional solder multi-contact connector are transformed to a distinctive structure with a group of U-shaped bayonets staggered fore and aft in two rows, for clamping and piercing the core wires of the cables and closely contacting the conductors thereof, thereby achieving the purpose of omitting soldering and improving the fabricating efficiency.

The connector is featured in transforming the conventional parallel soldering points in piercing connection to U-shaped bayonets forming a right angle and staggered fore and aft in two rows, thereby preventing a short circuit from occurring in a narrow space and further ensuring the stability of characteristic impedance.

Another object of the connector is to facilitate the assembling of the wire and connector, so as to ensure the electrical conduction and mechanical cooperation between the cable conductor and the U-shaped bayonets.

Specifically speaking, the present invention discloses a bayonet type electronic connector, wherein, the metal contacts on the upper and lower surfaces of the connector are U-shaped bayonets forming a right angle, the adjacent U-shaped bayonets forming a right angle on each surface are staggered fore and aft in two rows, and enough functional space is arranged between the two rows of U-shaped bayonets on each surface of the connector and between the two rows of U-shaped bayonets on the upper and lower surfaces of the connector, thereby overcoming the defect of violent fluctuation of high-frequency characteristic impedance in conventional soldered and general piercing connectors.

The U-shaped bayonet and the contacting point are the two ends of one piece of contact body, wherein the tail ends of the U-shaped bayonets are open with narrow slots for piercing the cable insulations and tightly clamping the cable conductors, and the contacting point is the head end of the metal contact.

The tail of the U-shaped bayonets forms a right angle, and is individually connected to the contacting points of the metal contact plate assembly.

The connector further includes a pair of plastic clips fitting with the U-shaped bayonets, and a group of round through holes through which the wires are allowed to pass are arranged at the middle portion of the plastic clips, in which the axis of the round through holes is perpendicular to the U-shaped bayonets and the wires inserted into the round through holes is also perpendicular to the U-shaped bayonets, thereby simplifying the arrangement of the core wires and ensuring the parallel transmission of electrical signals, and further ensuring the stability of the characteristic impedance of the connector and greatly improving the attenuation of the electrical signals.

A group of square through holes which correspond to the U-shaped bayonets for tightly pressing the plastic clips, the U-shaped bayonets and the cables are arranged on the plastic clips.

The plastic clips are additionally provided with multiple recesses each of which has an elongated circular cross-section and used for accommodating an aluminum foil and a ground wire of a high-frequency twisted pair, so as to prevent a short circuit of the aluminum foil and the ground wire of the adjacent twisted pair and to improve the stability of the characteristic impedance of the connector and further to improve the signal attenuation.

A conventional monolithically-formed plastic insulator is separated into four pieces. The upper and lower surfaces of the connector are respectively formed by two plastic insulators, and the metal contact plate assembly is injection overmolded by an insulator and then inserted into the metal shells to form one piece, thereby greatly reducing the structural complexity and processing difficulty, improving the fabricating efficiency and enhancing the control over the characteristic impedance of the connector.

A group of protruding flaps is respectively arranged on the two sides of the connector and the clips, for the precise positioning of the connector and wires in an assembling process.

The bayonet type electronic connector further includes a pair of metal shells, which are assembled with the connector for shielding and meanwhile grasping the cables. Two groups of slots are arranged on the two sides of an inner shell of the metal shells, which fit with the flaps of the connector and the clips.

The present invention also includes a stamping die for factory assembling and an auxiliary external frame for on-site cable installation at a construction site, and optionally includes a metal shielding shell. The aforementioned stamping die, auxiliary external frame and metal shielding shell all fit with the two groups of flaps.

Two groups of grooves are arranged on the cavity side walls of the lower die of the stamping die to serve as guide rails to fit with the two groups of flaps, and the upper die of the stamping die has protrusions and fits with the lower die of the stamping die through the guide pillars and guide bushes arranged on the upper die, so that the plastic clips are pressed tightly onto the connector, thereby realizing the assembly and conduction between the wires and the U-shaped bayonets.

The present invention further adopts a metal or plastic external frame to replace the stamping die, for assembling the clips and the connector. The tail end of the external frame has a bend to confine the clips, and two groups of square holes are arranged on the two sides of the external frame to fit with the flaps of the connector and the clips.

The bayonet type electronic connector further includes a pair of metal shells, which are assembled with the connector for shielding and meanwhile grasping the cables; two groups of slots are arranged on the two sides of an inner shell of the metal shells, which fit with the flaps of the connector and the clips.

The bayonet type electronic connector of the present invention enables cable factories and installation workers to use a new processing manner to replace the solder-type processing manner, thus improving the efficiency and meanwhile greatly improving the precision and stability of electrical performance such as the characteristic impedance and improving the signal attenuation.

The connector is applicable to the connection of a high-definition DVD player, a TV set, a computer host and a display, and other household and industrial electrical appliances.

Compared with the conventional U-shaped bayonets, the U-shaped bayonet type connector of the present invention enables the adjacent wires and the contact plates to be in a parallel state without twisted current after the wires are assembled, thus ensuring the stability of characteristic impedance and greatly improving high--frequency attenuation. Therefore, the U-shaped bayonet type connector of the present invention is applicable to a high-frequency situation. Moreover, since the present invention uses the clips, the U-shaped bayonet type connector of the present invention can be used not only to clamp the ribbon cables but also to clamp multi-core round cables, and meanwhile, because of the structural design of the clips, the assembly strength of the products can be enhanced. Since the U-shaped bayonets are arranged on the upper and lower surfaces, the problem of narrow space can be resolved and the high-frequency characteristic impedance of the connector also can be ensured.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
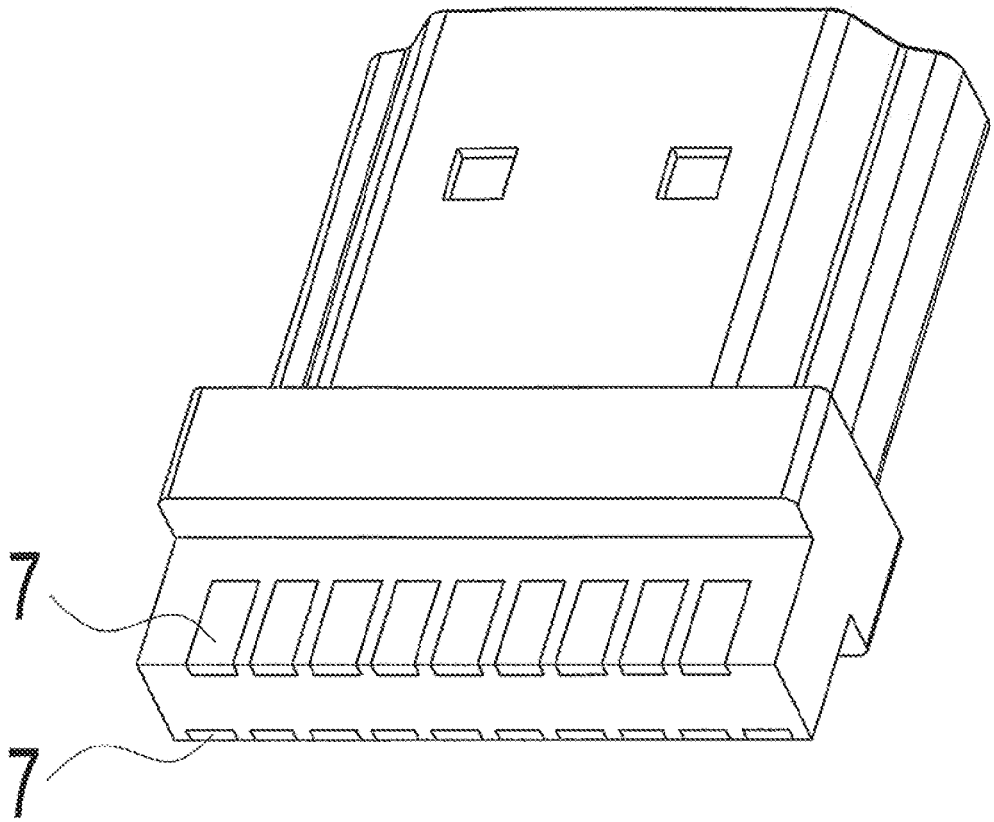
Fig. 1 (PRIOR ART)
FIG. 1 is a schematic view showing a conventional solder-type multi-contact connector.
Figure 2:
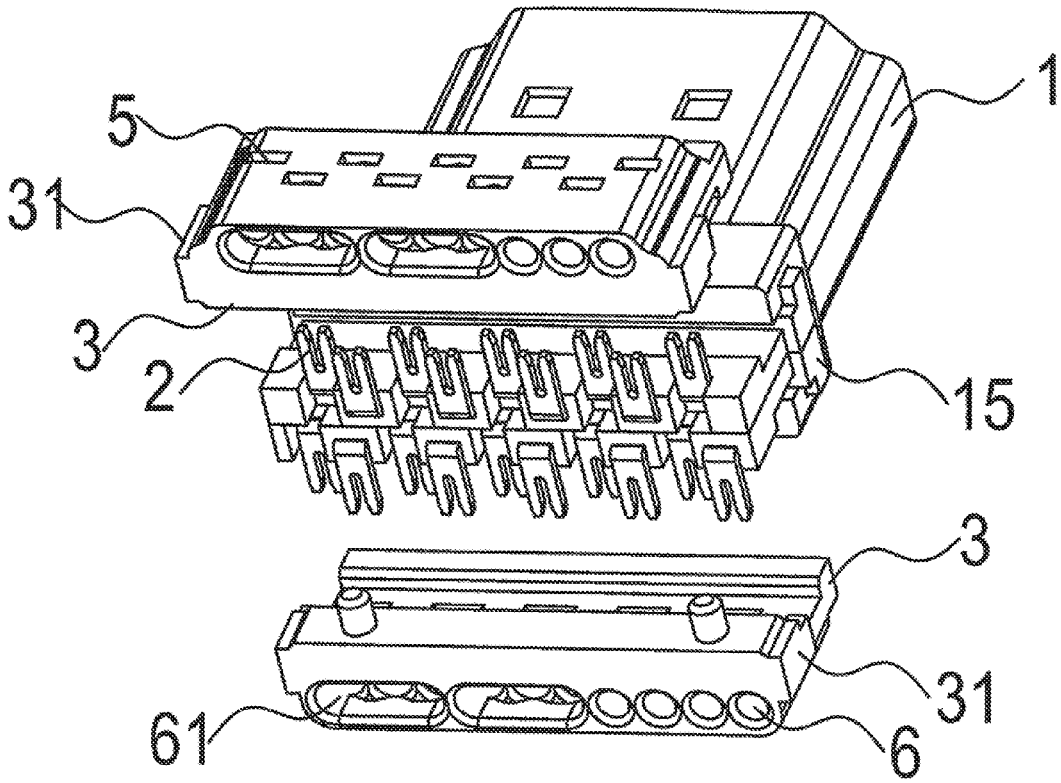
FIG. 2 is a schematic view showing separate parts of the present invention.
Figure 3:
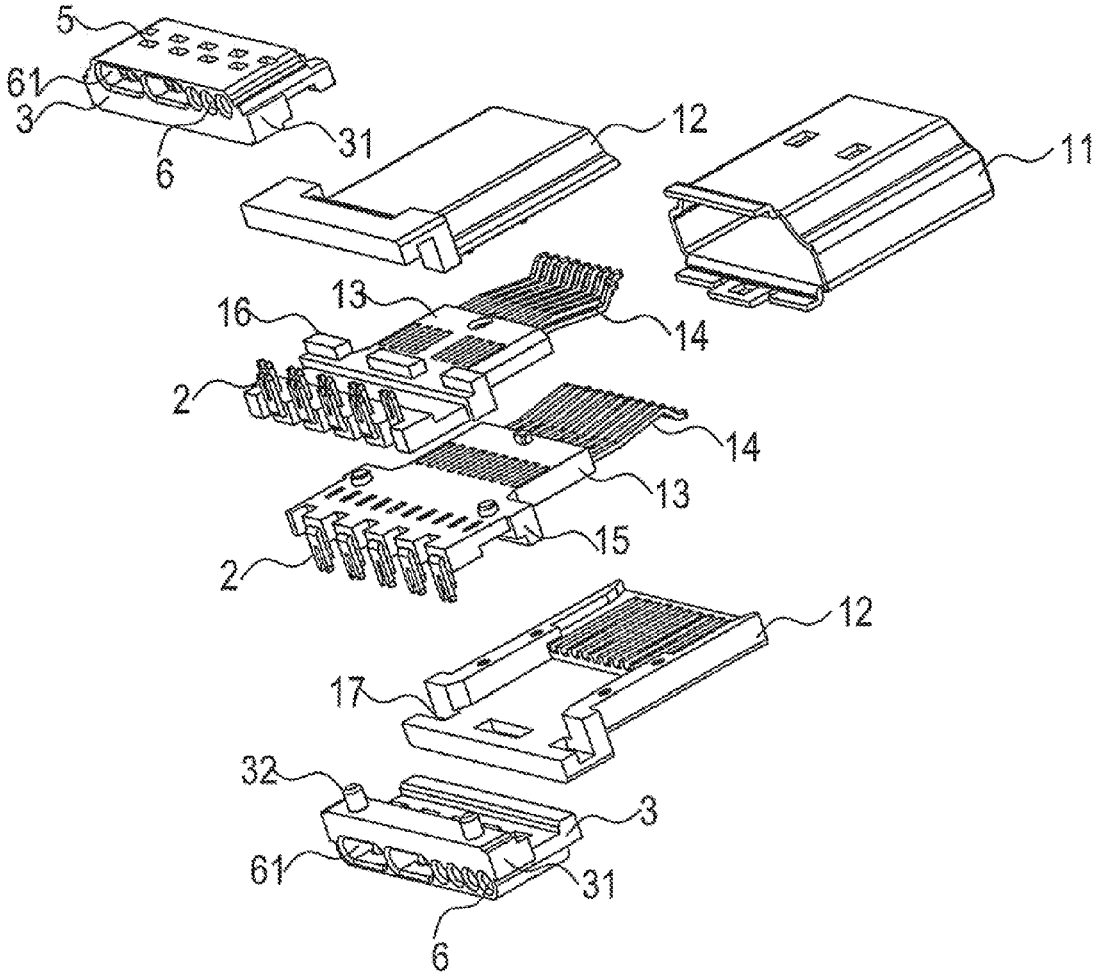
FIG. 3 is a schematic complete view showing detailed separate parts of the present invention.
Figure 4:
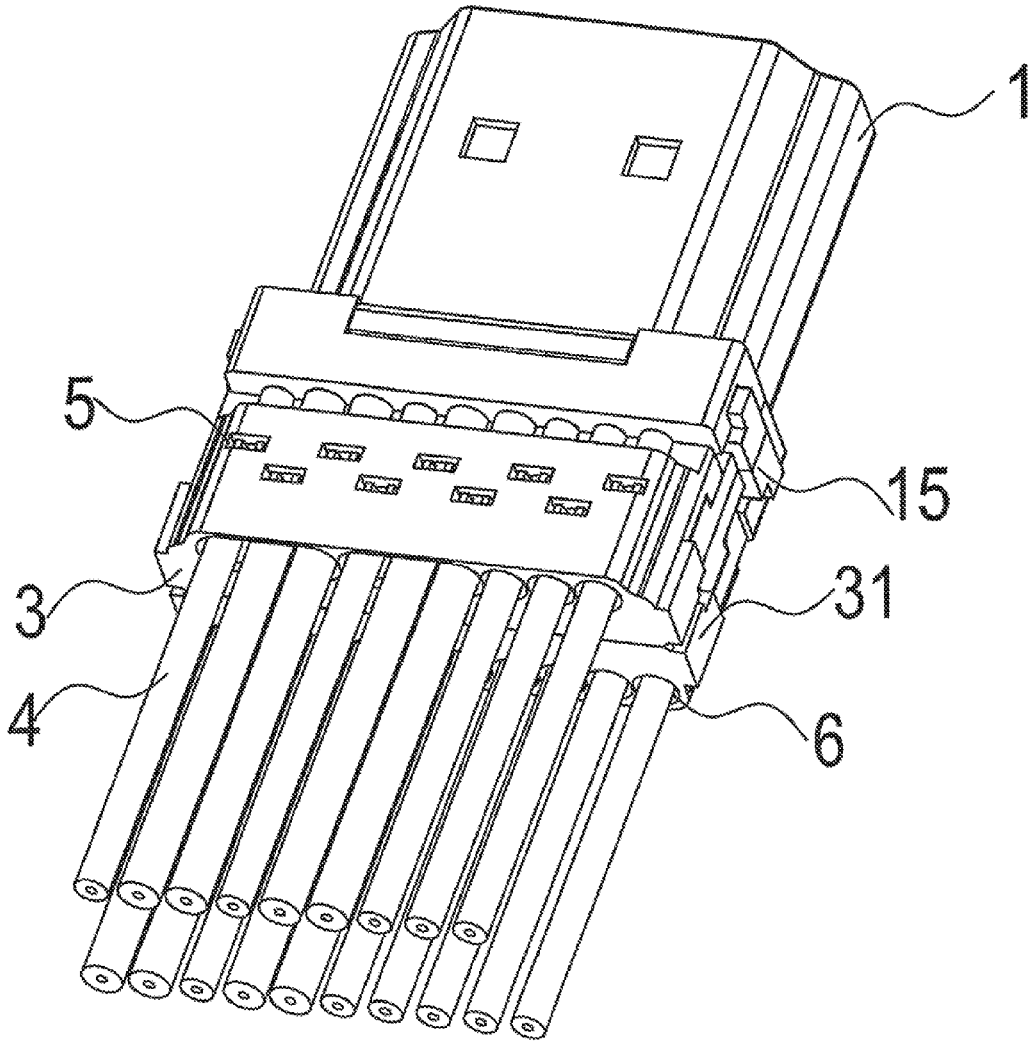
FIG. 4 is a schematic view showing an assembly of the present invention.
Figure 5:
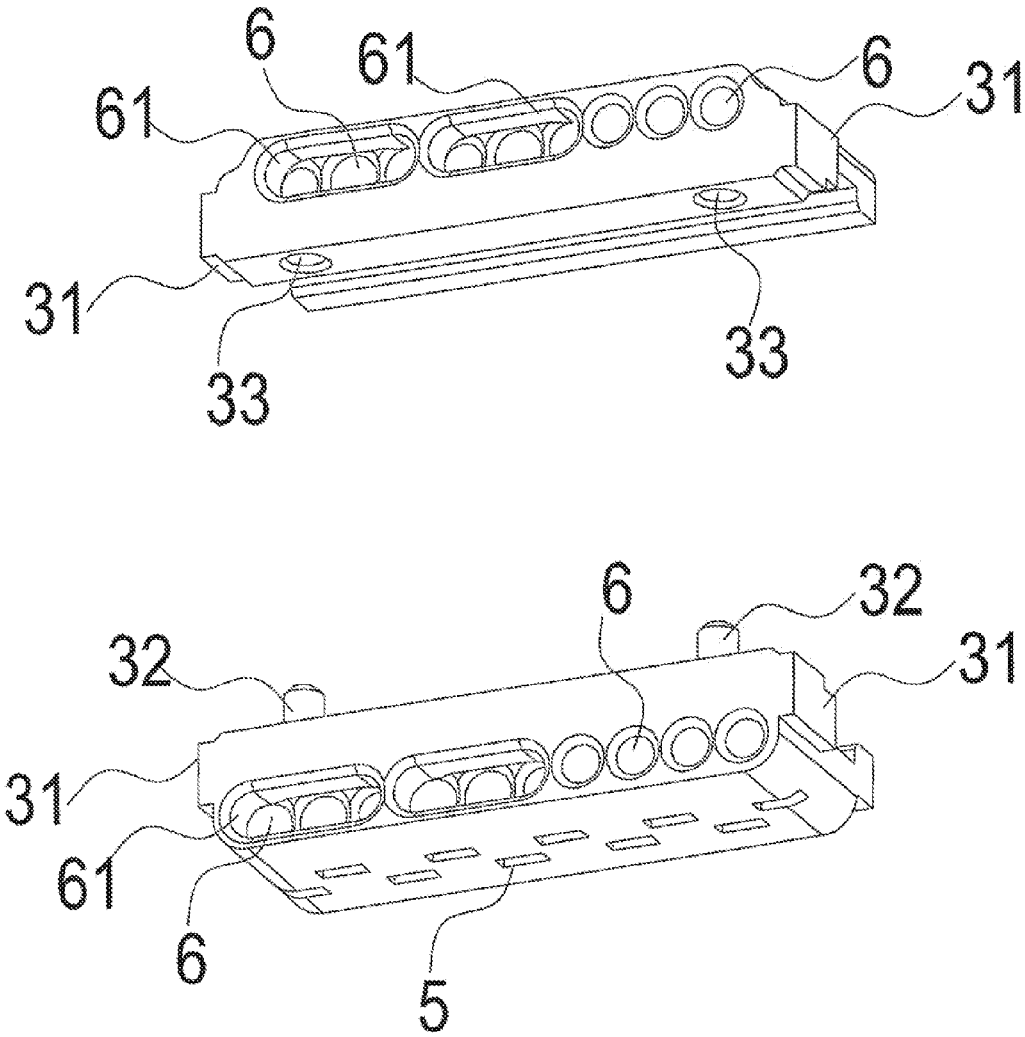
FIG. 5 is a schematic structural view showing a clip of the present invention.

The present invention changes the metal solder points 7 of a conventional solder-type multi-contact connector to a U-shaped bayonet structure forming a right angle, and the U-shaped bayonets 2 are staggered fore and aft in two rows, so that enough functional space is ensured between the two rows of U-shaped bayonets on each surface of the connector and between the two rows of U-shaped bayonets on the upper and lower surfaces of the connector to prevent a short circuit and the stability of the characteristic impedance of the connector is ensured. FIGS. 2 and 3 are exploded views of the present invention.

The present invention is featured in that the monolithically formed plastic insulator of the conventional connector is separated into four pieces with four layers in total, i.e. insulators 12 and 13, and the metal contact plate assembly 14 is firstly injection over-molded by an insulator 13 (the insulator 13 is plastic) and then inserted into the metal shells 11 to form one piece. This design greatly reduces the structural complexity of the insulator and the processing difficulty in assembling the contact plate assembly 14, thus improving the fabricating efficiency and enhancing the control over the characteristic impedance of the connector, as shown in FIG. 3.

Figure 6:
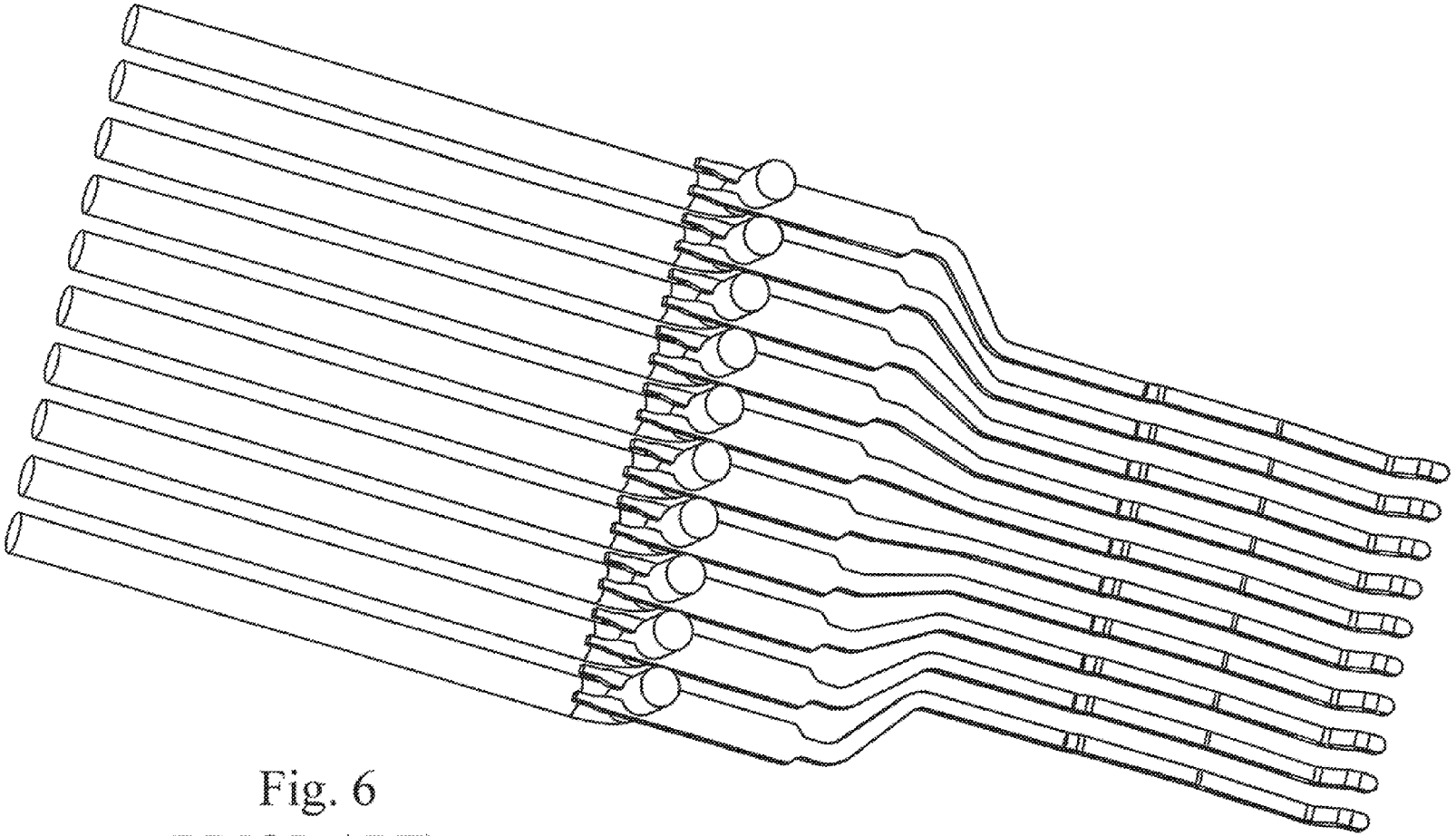
Fig. 6 (PRIOR ART)
FIG. 6 is a schematic view showing an assembly of the parallel contact plates and wires of a conventional piercing connector.

FIG. 6 is a schematic view showing the connection of a conventional parallel type piercing connector commonly seen in the market. In this structure, the bayonets are linearly in parallel and a large distance is required between every two adjacent bayonets. Otherwise, a short circuit easily occurs, and the wires need to be sharply bent, thus causing the fluctuation of high-frequency characteristic impedance of cables and increasing signal attenuation.

As can be seen from FIGS. 2 and 3, in the present invention, the U-shaped bayonets are separately connected to the metal contact plates of the metal contact plate assembly 14, and the tails of the U-shaped bayonets 2 of the present invention form a right angle. The U-shaped bayonet and the contacting point are the two ends of one piece of contact body, wherein the tail ends of the U-shaped bayonets are open with narrow slots 21 for piercing the insulations of the wire 4 and tightly clamping the cable conductors. When the narrow slot 21 pierces the insulations of the wire 4, it closely clamps the conductor 41 at the same time, so as to ensure a close electrical contact, as shown in FIG. 11.

The tail of the U-shaped bayonets forms a right angle, and is individually connected to the contacting points of the metal contact plate assembly.

In order to achieve the precise and highly efficient assembling of the wire 4 and the connector 1, the present invention adds a pair of plastic clips 3, and each plastic clip 3 has a group of round through holes 6 for a wire to insert arranged thereon, and a group of square through holes 5 closely fitting with the U-shaped bayonets 2 are also arranged. Referring to FIGS. 2 and 11, each U-shaped bayonet 2 is perpendicular to the axis direction of the round through holes, and the cable core wires thread the round through holes to be perpendicular to the U-shaped bayonets. For the aluminum foil Shielded Twisted Pair (STP) of high-frequency digital cables, the clips are particularly designed with multiple recesses 61 each of which has an elongated circular cross-section and is used for accommodating an aluminum foil and a ground wire, thereby not only preventing a short circuit of the adjacent twisted pairs from occurring, but also improving the stability of the characteristic impedance of the connector and further improving the signal attenuation. Please refer to FIGS. 2, 3, 4, and 5.

Figure 7:
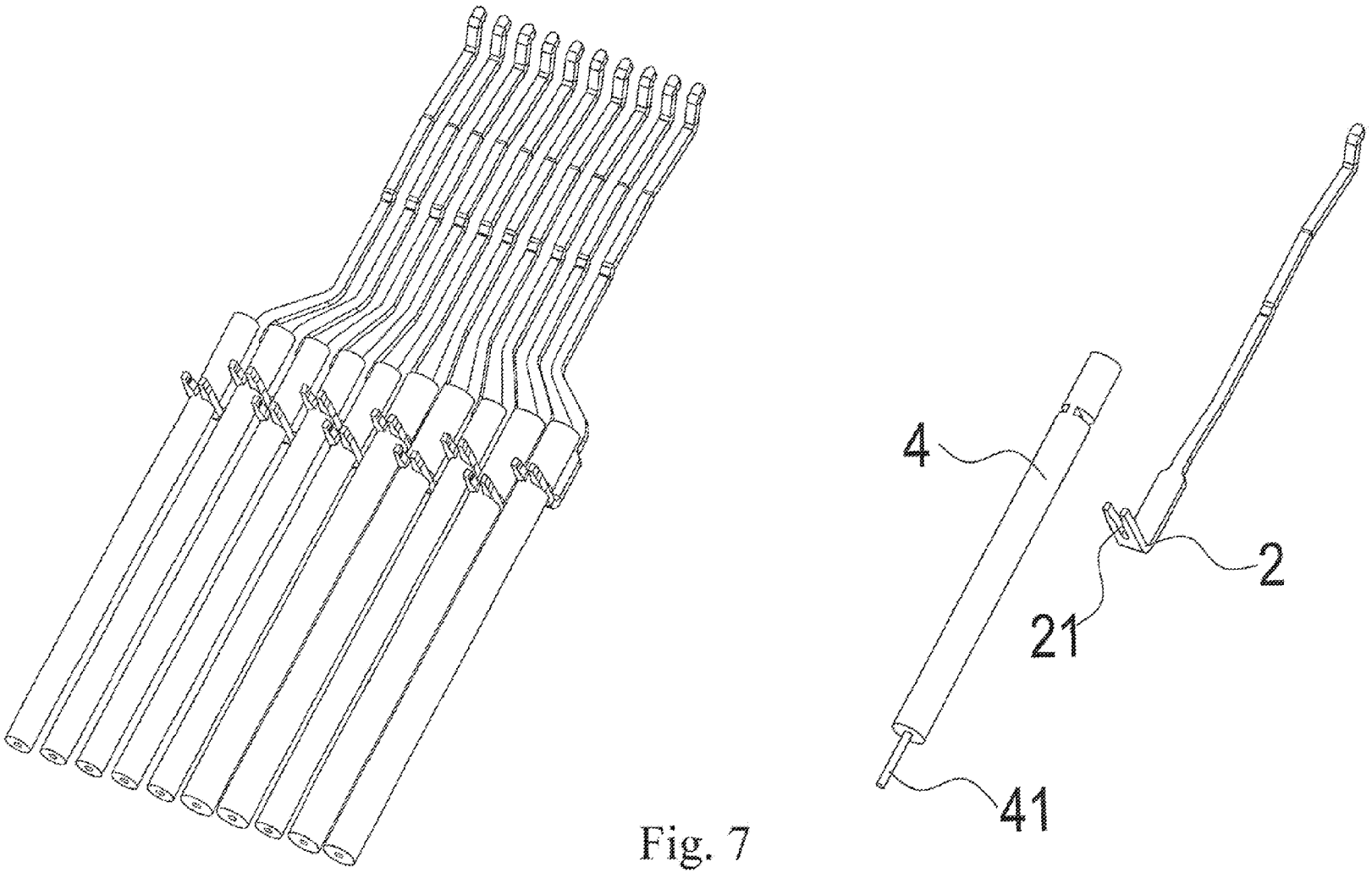
FIG. 7 is a schematic view showing the contact plates that form a right angle piercing the wires according to the connector of the present invention.
Figure 8:
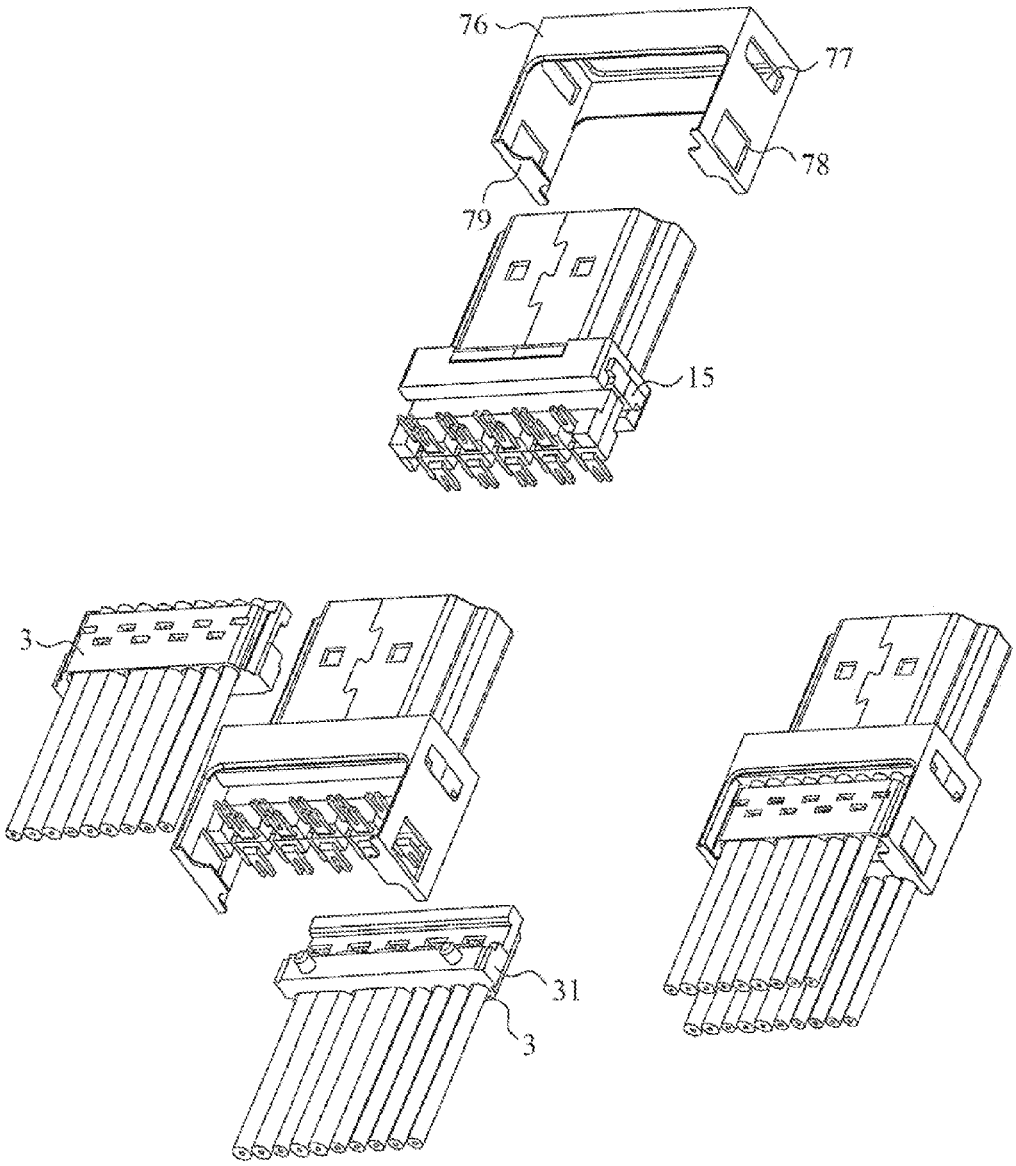
FIG. 8 is a schematic view of the structure and functions of an external frame of the present invention.
Figure 9:
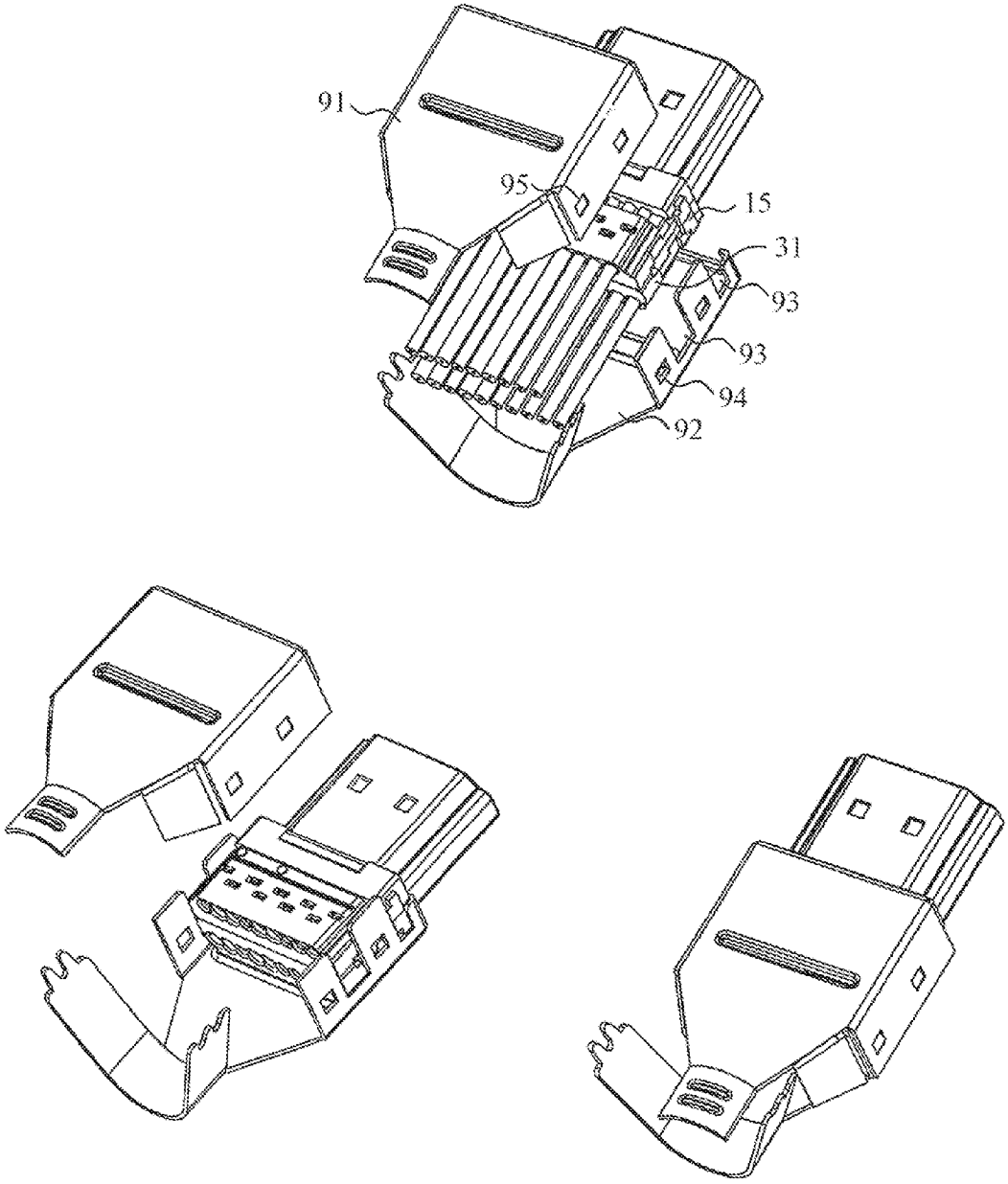
FIG. 9 is a schematic view showing the structure and functions of a metal shielding shell of the present invention.
Figure 10:
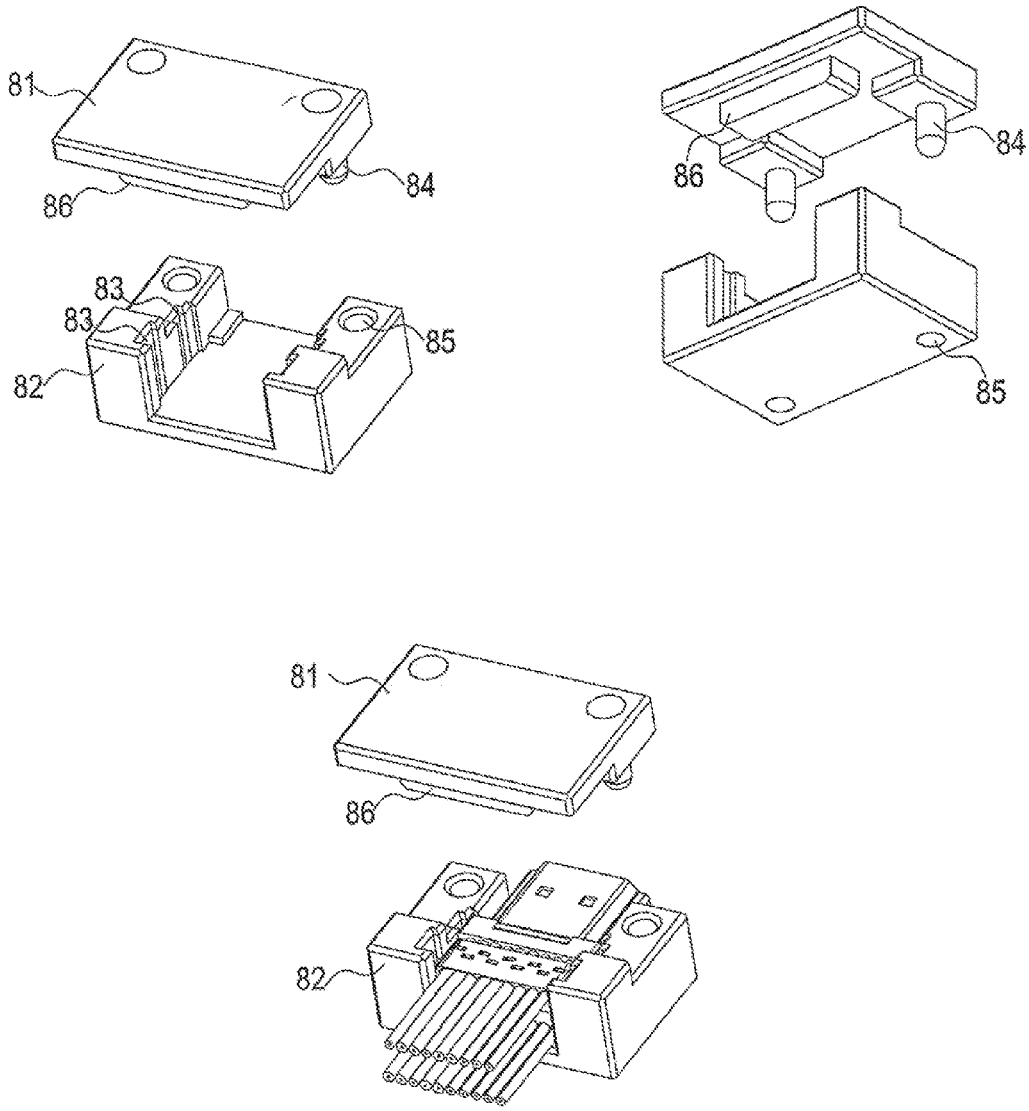
FIG. 10 is a schematic view showing the structure and functions of a mating stamping die of the present invention.

Referring to FIG. 7, FIG. 7 is a schematic view showing the U-shaped bayonets piercing the cable core wires according to the present invention. In the present invention, the metal contacts on the upper and lower surfaces are all U-shaped bayonets. The U-shaped bayonets are staggered fore and aft in two rows, thereby saving space and overcoming the problem of a short circuit, and thus the cable core wires may be arranged in parallel so as to stabilize the high-frequency characteristic impedance and improve the attenuation of an electrical signal.

A group of protruding flaps 15 are arranged on the two sides of the connector 1, and a group of protruding flaps 31 are arranged on the two sides of clips 3, for precisely positioning the connector 1 and the cable 4 in an assembling process. Protrusions 16 are arranged on the flaps 15, and the protrusions 16 are closely fitted with the grooves 17 on the insulators 12 and 13. Please refer to FIGS. 3, 4, 8, 9, and 10.

The wire group 4 can smoothly pass through the two groups of round through holes 6 on the clips 3 and then a group of square holes 5 on the clips are aligned with the U-shaped bayonets 2 of the connector, and thereafter, by using the processing manner of pressing and fitting the respective parts into one body, the clips 3, U-shaped bayonets 2 and wire 4 are assembled. In this process, all the U-shaped bayonets 2 pierce the jackets of the corresponding wire 4, and meanwhile closely clamp the conductor 41 of the wire 4. Also, the upper and lower clips are closely joined through the tight fit between the pillars 32 and holes 33 (referring to FIG. 5), thereby enabling a stable assembly. For the semi-finished product after assembling, please refer to FIG. 4.

To facilitate the assembling of cable factories, the present invention has a stamping die, wherein two groups of grooves 83 are arranged on the cavity side walls of the lower die 82 to serve as guide rails to fit with the two groups of flaps 15 and 31 of the connector, and protrusions 86 are arranged on its upper die 81 for tightly pressing the clips. The upper die 82 fits with the lower die 82 through the guide pillars 84 and guide bushes 85, and thus the plastic clips 3 are pressed tightly onto the connector 1, thereby enabling the assembling and conduction of the wire 4 and U-shaped bayonets 2.

To facilitate assembling for on-site cable installation workers, the present invention is optionally provided with a metal or plastic external frame 76, for assembling the clips 3 and the connector 1, which can replace the above stamping die. The tail end of the external frame 76 has a bend 79 to confine the clips 3, and two groups of square holes 77 and 78 are arranged on the two sides of the external frame to fit with the flaps 15 and 31 of the connector 1 and the clips, so as to ensure the assembly strength of the cables and connector. Please refer to FIG. 8.

In order to ensure the electromagnetic shielding effect, the present invention is optionally provided with a pair of metal shells 91 and 92, which are assembled with the connector 1 for shielding. Meanwhile, the tail ends of the metal shells are stamped for grasping the cables. Two groups of slots 93 are arranged on the two sides of the metal shell 92 to fit with the flaps 15 and 31 of the connector and the clips, so as to ensure the precision and strength of the assembly. The metal shells 91 and 92 are tightly engaged with the square holes 94 through the barb 95. Please refer to FIG. 9.

After the assembling process described above, the wire 4 is steadily connected with the connector 1, and then the steps of injection, assembling of the finished product, and testing can be performed.

Industrial Applicability

The bayonet type electronic connector and stamping die of the present invention allow cable factories to use a new processing manner to replace the soldering processing manner, which improves the efficiency and also greatly enhances the precision and stability of electrical performance.

The connector is applicable to the connection of a high-definition DVD player, a TV set, the host and display of a computer, and other household and industrial electrical appliances.

What is claimed is:

1. A bayonet type electronic connector, wherein a plurality of metal contacts disposed on an upper and a lower surfaces of the connector are all U-shaped bayonets, the U-shaped bayonet's tail forms a right angle, the adjacent U-shaped bayonets on each surface are staggered fore and aft in two rows, and enough functional space is arranged between the two rows to prevent a short circuit;

the connector further comprising a pair of plastic clips fitting with the U-shaped bayonets, and a group of round through holes through which wires are allowed to pass are arranged at the middle portion of the plastic clips to alleviate attenuation of an electrical signal;

wherein a group of square through holes fitting with the U-shaped bayonets for pressing the U-shaped bayonets and the wires are arranged on the plastic clips.

2. A bayonet type electronic connector, comprising:

a plurality of metal contacts disposed on an upper and a lower surfaces of the connector, wherein the metal contacts are all U-shaped bayonets, and the adjacent U-shaped bayonets on each surface are staggered fore and aft in two rows, and enough functional space is arranged between the two rows of U-shaped bayonets on each surface of the connector and between the two rows of U-shaped bayonets on the upper and lower surfaces of the connector to prevent a short circuit; and a pair of plastic clips fitting with the U-shaped bayonets, and a group of round through holes through which wires are allowed to pass are arranged at the middle portion of the plastic clips to alleviate attenuation of an electrical signal;

wherein a group of square through holes fitting with the U-shaped bayonets for pressing the U-shaped bayonets and the wires are arranged on the plastic clips.

3. The bayonet type electronic connector according to claim 2, wherein the U-shaped bayonet and the contacting point are the two ends of one piece of contact body, and the tail ends of the U-shaped bayonets are open with narrow slots for piercing the cable insulations and tightly clamping the cable conductors.

4. The bayonet type electronic connector according to claim 1, wherein the group of plastic clips are respectively formed from an upper clip and a lower clip, and the upper clip and the lower clip are respectively provided with corresponding pillars and holes so as to ensure a tight fit between the upper clip and the lower clip.

5. The bayonet type electronic connector according to claim 1, wherein the plastic clips are additionally provided with multiple recesses each of which has an elongated circular cross-section and is used for accommodating an aluminum foil and a ground wire of a high-frequency twisted pair, so as to prevent a short circuit in aluminum foils and ground wires of the adjacent twisted pairs and improve the signal attenuation.

6. The bayonet type electronic connector according to claim 4, wherein the upper and lower surfaces of the connector are respectively formed from two layers of plastic insulator.

7. The bayonet type electronic connector according to claim 5, wherein a group of protruding flaps are arranged respectively on the two sides of the plastic insulator of the connector and on the two sides of the clips, for precise positioning of the connector and wires in an assembling process.

8. The bayonet type electronic connector according to claim 6, further comprising a stamping die, wherein two groups of grooves are arranged on the cavity side walls of the lower die of the stamping die to serve as guide rails to fit with the two groups of flaps, and the upper die of the stamping die has protrusions and fits with the lower die of the stamping die through guide pillars and guide bushes arranged on the upper die of the stamping die, so that the plastic clips are pressed tightly onto the connector, thereby realizing assembly and conduction between the wires and the U-shaped bayonets.

9. The bayonet type electronic connector according to claim 6, further comprising a metal or plastic external frame, for assembling of the clips and the connector, wherein, the tail end of the external frame has a bending to confine the clips, and two groups of square holes are arranged on the two sides of the external frame to fit with the flaps of the connector and the clips.

10. The bayonet type electronic connector according to claim 6, further comprising a pair of metal shells, which are assembled with the connector for shielding and meanwhile grasping the cables, wherein two groups of slots are arranged on the two sides of an inner shell of the metal shells to fit with the flaps of the connector and the clips.

11. The bayonet type electronic connector according to claim 3, wherein the tail of the U-shaped bayonets forms a right angle, and is individually connected to the contacting points of the metal contact plate assembly.

12. The bayonet type electronic connector according to claim 2, 3 or 11, wherein the axis of the round through holes is perpendicular to the U-shaped bayonets and the wires inserted into the round through holes is also perpendicular to the U-shaped bayonets.

13. The bayonet type electronic connector according to claim 2, wherein the group of plastic clips are respectively formed from an upper clip and a lower clip, and the upper clip and the lower clip are respectively provided with corresponding pillars and holes so as to ensure a tight fit between the upper clip and the lower clip.

14. The bayonet type electronic connector according to claim 2, wherein the plastic clips are additionally provided with multiple recesses each of which has an elongated circular cross-section and is used for accommodating an aluminum foil and a ground wire of a high-frequency twisted pair, so as to prevent a short circuit in aluminum foils and ground wires of the adjacent twisted pairs and improve the signal attenuation.

15. The bayonet type electronic connector according to claim 13, wherein the upper and lower surfaces of the connector are respectively formed from two layers of plastic insulator, and the metal contact plates are injection overmolded by an insulator and then inserted into the metal shells to form one piece.

16. The bayonet type electronic connector according to claim 15, wherein a group of protruding flaps are arranged respectively on the two sides of the plastic insulator of the connector and on the two sides of the clips, for precise positioning of the connector and wires in an assembling process.

17. The bayonet type electronic connector according to claim 16, further comprising:

a pair of metal shells, which are assembled with the connector for shielding and meanwhile grasping the cables, wherein two groups of slots are arranged on the two sides of an inner shell of the metal shells to fit with the flaps of the connector and the clips.

18. The stamping die of the bayonet type electronic connector according to claim 16, further comprising:

the stamping die, wherein the stamping die comprises an upper die and a lower die, and two groups of grooves are arranged on the cavity side walls of the lower die of the stamping die to serve as guide rails to fit with the two groups of flaps, and the upper die of the stamping die has protrusions for pressing the clips; through the fitting between the guide pillars and guide bushes arranged on the upper die of the stamping die and the lower die of the stamping die, and the plastic clips are pressed tightly onto the connector, thereby realizing assembly and conduction between the wires and the U-shaped bayonets.

19. The metal or plastic external frame of the bayonet type electronic connector according to claim 16, further comprising:

a metal or plastic external frame, wherein, for assembling of the clips and the connector, the tail end of the external frame has a bending to confine the clips, and two groups of square holes are arranged on the two sides of the external frame to fit with the flaps of the connector and the clips.

* * * * *